United States Patent [19]

Van Gorkum et al.

[11] Patent Number: 4,899,079

[45] Date of Patent: Feb. 6, 1990

[54] CATHODE RAY TUBE

[75] Inventors: Aart A. Van Gorkum; Leopold C. M. Beirens; Gerardus A. H. M. Vrijssen, all of Eindhoven, Netherlands

[73] Assignee: U.S. Philips Corporation, New York, N.Y.

[21] Appl. No.: 709,464

[22] Filed: Mar. 7, 1985

[30] Foreign Application Priority Data

Mar. 12, 1984 [NL] Netherlands ..... 8400779

[51] Int. Cl.[4] ..... H01J 29/58

[52] U.S. Cl. ..... 313/412

[58] Field of Search ..... 313/412, 414, 426, 428, 313/432, 439, 450, 479

[56] References Cited

U.S. PATENT DOCUMENTS

| | | | |
|---|---|---|---|
| 2,123,636 | 7/1938 | Schwartz | 313/450 |
| 3,011,090 | 11/1961 | Moodey | 313/412 X |
| 3,143,681 | 8/1964 | Schlesinger | 313/450 |
| 3,223,871 | 12/1965 | Schlesinger | 313/450 |
| 3,374,386 | 3/1968 | Charbonnier et al. | 353/85 |
| 3,909,655 | 9/1975 | Grimmett et al. | 313/450 |

FOREIGN PATENT DOCUMENTS

| | | | |
|---|---|---|---|
| 1067754 | 5/1967 | United Kingdom | 313/450 |

*Primary Examiner*—Donald J. Yusko
*Assistant Examiner*—Sandra L. O'Shea
*Attorney, Agent, or Firm*—Robert J. Kraus

[57] ABSTRACT

In a color display tube including an envelope, a display screen, an electron gun system for producing and focusing a plurality of electron beams directed at the display screen, and coils for deflecting the beams, convergence of the beams independently of focusing is effected by a helically wound resistive element disposed in the envelope between the electron gun system and the deflection coils. The element surrounds the electron beams and is dimensioned such that, when predetermined potentials are applied thereto, a potential gradient is produced along its length which establishes a relatively large diameter, strong convergence lens through which the beams pass.

10 Claims, 4 Drawing Sheets

CATHODE RAY TUBE

BACKGROUND OF THE INVENTION

The invention relates to a cathode ray tube comprising in an evacuated envelope means to generate at least two electron beams which are converged completely or substantially completely on a display screen and are deflected over the display screen to write a field. Each electron beam is focussed on the display screen to form a spot by at least one focusing lens.

Such cathode ray tubes are used as colour television display tubes, as colour DGD display tubes for displaying symbols and/or figures (DGD=Data Graphic Display), as tubes having a high display rate for displaying computer data, or as projecting television display tubes.

Such a cathode ray tube is disclosed in U.S. Pat. No. 3,906,279 which may be considered to be incorporated herein by reference. This Specification describes an electron gun system for generating three electron beams, which system comprises three electron guns situated with their axes parallel and in one plane. As a result of the eccentric arrangement of the last electrodes of the outermost electron guns a two-pole component is associated with the lens fields in the focusing lenses of the electron guns as a result of which the outermost electron beams are deflected towards the central electron beam so that the three electron beams converge on the display screen.

U.S. Pat. No. 4,291,251 which may be considered to be incorporated herein by reference, is a cathode ray tube having a similar electron gun system in which the outermost electron beams are not converged in the focusing lenses but in the triode part of the two outermost electron guns. The triode part of an electron gun is formed by the cathode, the control electrode (g-1) and the first anode (g-2).

U.S. Pat. No. 3,011,090 which may also be considered to be incorporated herein by reference, discloses a cathode ray tube having an electron gun system with electron guns the parallel axes of which are situated at the same distance from each other. The last cylindrical electrode of the electron gun system is common to the three electron beams and together with the electrically conductive wall coating on the inner wall of the neck of the cathode ray tube constitutes an electron lens converging all beams. The effective diameter of the convergence lens is between the diameter of the last cylindrical electrode and the inside diameter of the neck with the electrically conductive wall coating. This latter will be further explained hereinafter.

U.S. Pat. No. 3,748,514 which may be considered to be incorporated herein by reference discloses a cathode ray tube in which the electron gun system comprises a long helical electrode for accelerating a large number of electron beams in such manner that space charge repelling of the beams is compensated for. In the last part of the helical electrode, all electron beams are simultaneously converged on and focussed on and then deflected over the display screen. The convergence and focussing is magnetic and occurs by means of a focusing coil around a part of the helical electrode situated on the display screen side. A disadvantage of this tube is that all electron beams simultaneously are focussed and converged by the same lens. Focusing and convergence are hence coupled so that dynamic convergence becomes impossible.

The manner of converging as described in U.S. Pat. Nos. 3,906,279, 4,291,251 and 3,011,090 have for their result that the spherical aberration in the electron beams increases. The convergence according to U.S. Pat. No. 3,906,279 moreover takes place while being coupled with the focusing.

SUMMARY OF THE INVENTION

It is therefore an object of the invention to provide a cathode ray tube in which the spherical aberration as a result of the convergence is minimum in which the focusing of the electron beams and the convergence are adjustable individually and, if necessary, dynamically.

According to the invention, a cathode ray tube of the kind mentioned in the opening paragraph is characterized in that all electron beams emanating from the focusing lenses are converged at least partly by a helical lens which is common to all electron beams and has a length $1 \leqq 2D$, 1 being the length of the helix and D the diameter of the helix.

In a number of the so far known helical electrodes, for example, the electrode described in the already mentioned U.S. Pat. No. 3,748,514, the length 1 was many times larger than the diameter D as a result of which an accelerating anode rather than an electron lens was obtained. By choosing 1 to be $\leqq 2D$, a sufficiently strong lens action can be obtained.

When a lens for converging a number of electron beams is used, the beams may be considered as sub-rays of one large beam which is focused. By using a helical lens, for example, on the inner wall of the neck of the cathode ray tube, the lens diameter is as large as possible and is, for example, equal to the inside diameter of the neck. In the already mentioned U.S. Pat. No. 3,011,090 the effective diameter of the lens, as already said, is between the diameter of the last cylindrical electrode and the inside diameter of the neck comprising the electrically conductive wall coating. The effective diameter hence is smaller than that of a helical lens on the neck wall, as a result of which the spherical aberration as a result of the lens according to the United States Patent Specification is larger. The spherical aberration in the electron beams as a result of the helical lens according to the invention is reduced not only by the comparatively large lens diameter but also by the presence of the helix, since therewith, as a result of the length of the helix, the field gradient in the lens can be kept small. If the electron beams, as compared with the so far known lenses, are situated at a comparatively small and approximately equal distance from the lens axis, the small spherical aberration of the convergence lens which will be expressed as a coma error in the spot of the outer electron beams on the display screen, has substantially no disturbing influence on the electron beams.

U.S. Pat. No. 3,452,246 discloses a helical lens for focusing one electron beam and not for converging a few already individually focused electron beams.

A first preferred form of a cathode ray tube in accordance with the invention is characterized in that the electron beams emanating from the focusing lenses extend substantially parallel to each other and are converged substantially by the helical lens, the focus of the helical lens being situated on or substantially on the display screen.

The focusing of each electron beam takes place substantially by the focusing lenses. If a convergence lens having a focal distance $f_c$ and a focusing lens having a focal distance $f_m$ are situated at approximately the same distance Q from the display screen, the convergence lens converges parallel electron beams on the screen if $f_c=Q$. The focusing lenses focus the electron beams on the display screen, in which the so-called cross-over formed immediately after the cathode is displayed on the display screen. For displaying an object (for example "cross-over"), the magnification M may be written as $$M = 1 - \frac{Q}{f_m}.$$

Substitution of $f_c=Q$ gives $$\frac{f_c}{f_m} = 1 - M$$

Because M is between −2 and −7 for most electron guns used in practice it follows that the focusing lens is always stronger than the convergence lens. The difference becomes larger for larger values of M.

A second preferred form of the cathode ray tube in accordance with the invention is characterized in that the electron beams emanating from the focusing lenses converge and the convergence is corrected by the helical lens so that the electron beams converge on or substantially on the display screen.

The correction of the convergence may be done dynamically during the deflection so that, for example, non-self-converging coils may also be used. The helical lens may be a bi- or uni-potential helical lens. The bi-potential helical lens may be an accelerating or a decelerating lens. The uni-potential helical lens consists of a helical electrode having a branch to which such a potential is applied that the potential gradient in a part of the helix is inverted. An advantage of such a unipotential helical lens is that the potential at the last electrode of the electron gun system may be equal to the potential on the display screen so that the electrodes of the electron gun system can be operated at the usual potentials. The tapping need not be provided in the centre of the helical electrode.

BRIEF DESCRIPTION OF THE DRAWING

The invention will now be described in greater detail, by way of example, with reference to a drawing, in which.

DESCRIPTION OF THE PREFERRED EMBODIMENT

Figure 1:
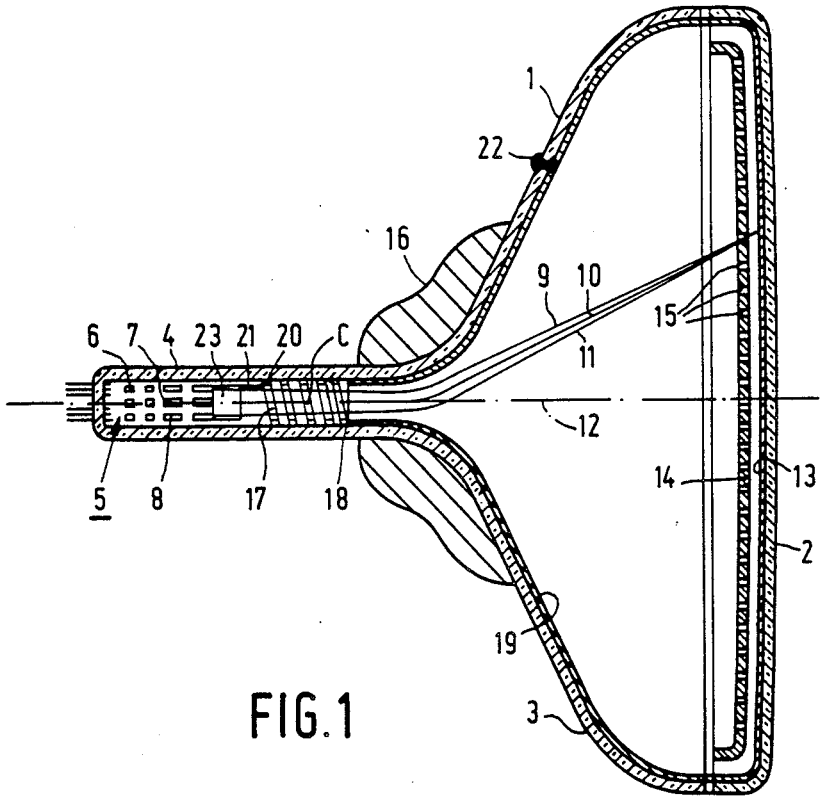
FIG. 1 is a longitudinal sectional view of a colour display tube according to the invention, FIG. 2 further explains the convergence by means of a helical lens with reference to a graph in which the measured relative spot positions x(mm) are plotted as a function of the electric voltage $V_s$(kV) at a helical lens.

FIG. 1 is a diagrammatic longitudinal sectional view of a cathode ray tube, in this case a colour display tube, according to the invention. The envelope 1 is composed of a display window 2, a cone 3 and a neck 4. An electron gun system 5 comprising three electron guns 6, 7 and 8 which generate the electron beams 9,10 and 11, respectively, is provided in the neck. The axis of the central electron gun 7 coincides with the tube axis 12. The display screen 13 is provided on the inside of the display window 2 and is composed of a large number of triplets of substantially parallel strips consisting of a luminescent material. Each triplet comprises in the same sequence a red-luminescing strip, a green-luminescing strip and a blue-luminescing strip. Right in front of the display screen a colour selection electrode 14 (for example a shadow mask) is provided which comprises a large number of rows of elongate apertures 15 parallel to the strips. The electron beams are deflected over the display screen 13 in two mutually perpendicular directions by means of the system of deflection coils 16. At their ends facing the display screen side each of the electron guns 6, 7 and 8 comprises a focusing lens with which the electron beams are focused on the display screen. The electron beams are converged on the display screen by means of a helical lens 17. Because of the convergence the electron beams enclose a small angle with each other at the area of the colour selection electrode 14. The electron beams pass through the apertures 15 at this angle and each impinge only on strips of luminescent material of one colour. The convergence of the electron beams may be done exclusively by the helical lens 17, as will be described in detail with reference to FIGS. 3 and 4. It is also possible, however, as will explained with reference to FIG. 2 and FIG. 5, to cause already partially converging electron beams to converge with the helical lens. In accordance with the invention, the convergence of electron beams by means of a helical lens is not restricted to colour display tubes in which the spots of the three electron beams on the display screen must be incident one on top of the other. In multi-beam tubes it is often necessary to converge a number of electron beams in such manner that the spots are situated at a small defined distance from each other, for example, a line distance. A helical lens is particularly suitable for this purpose. The invention can in principle be used in multi-beam tubes having two or more electron beams. In such tubes the spots may be situated in a row or matrix which is deflected over the display screen.

The end 18 of the helical lens 17 situated at the display screen is electrically connected to the electrically conductive inner coating 19 of the cone 3 which in turn is connected to the aluminium coating (not shown) of the display screen 13, the high voltage contact 22 and the colour selection means 14. The other end 20 of the helical lens 17 is electrically connected by means of a contact spring 21 to the gun end 23 and the last electrodes of the focusing lenses.

Figure 2:
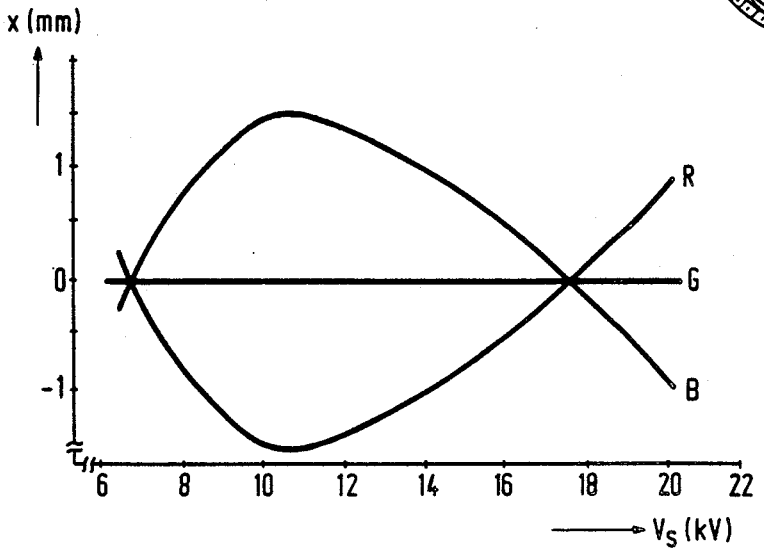

FIG. 2 shows the measured relative spot positions x(mm) for the spot R(ed), G(reen) and B(lue) as a function of the voltage of $V_s$(kV) across the helical lens in a display tube of the FIG. 1 type. For these measurements a display tube was used in which a uni-potential helical lens was provided on the inside of the display tube neck 4 (FIG. 1) having a diameter of 36 mm and an inside diameter of 32 mm. The helical lens had a length of 30 mm. The helical lens had 75 turns with a width of 0.35 mm and a pitch of 0.4 mm. The overall resistance was $10^{10}\Omega$. This means a power dissipation of approximately 0.6 W at a voltage of 25 kV across the helix. Such helical lenses may be manufactured from known materials from which electrical resistors are also manufactured, for example, metals, electrically conductive enamels and glasses etc.. A helical lens usually has 2 to 3 turns per mm. However, the number of turns per mm is not critical since in a helical lens it is the potential gradient that matters. The distance from the centre C of the helical lens to the display screen in this tube was 205 mm. The electron gun used was an "in line" electron gun as used in the colour display tubes of the type 30-AX of Philips (see "30 AX Self-aligning 110° in line colour-t.v. display", IEEE Trans. Cons. El., CE 24 (1978) 481). The distance from the gun to the centre C of the helical lens was 32 mm. During the measurements the last electrode of the electron gun and the end of the helical lens connected electrically thereto was kept at 10 kV. From the measurements it follows that at $V_s=10$ kV in which hence no voltage was across the helix, both the spots R and G and B were situated at a distance of approximately 1.5 mm from each other. By increasing or decreasing the voltage $V_s$ across the bi-potential helical lens, it was possible to cause the three electron beams to converge by making an accelerating or decelerating lens, respectively, out of it.

Figure 3:
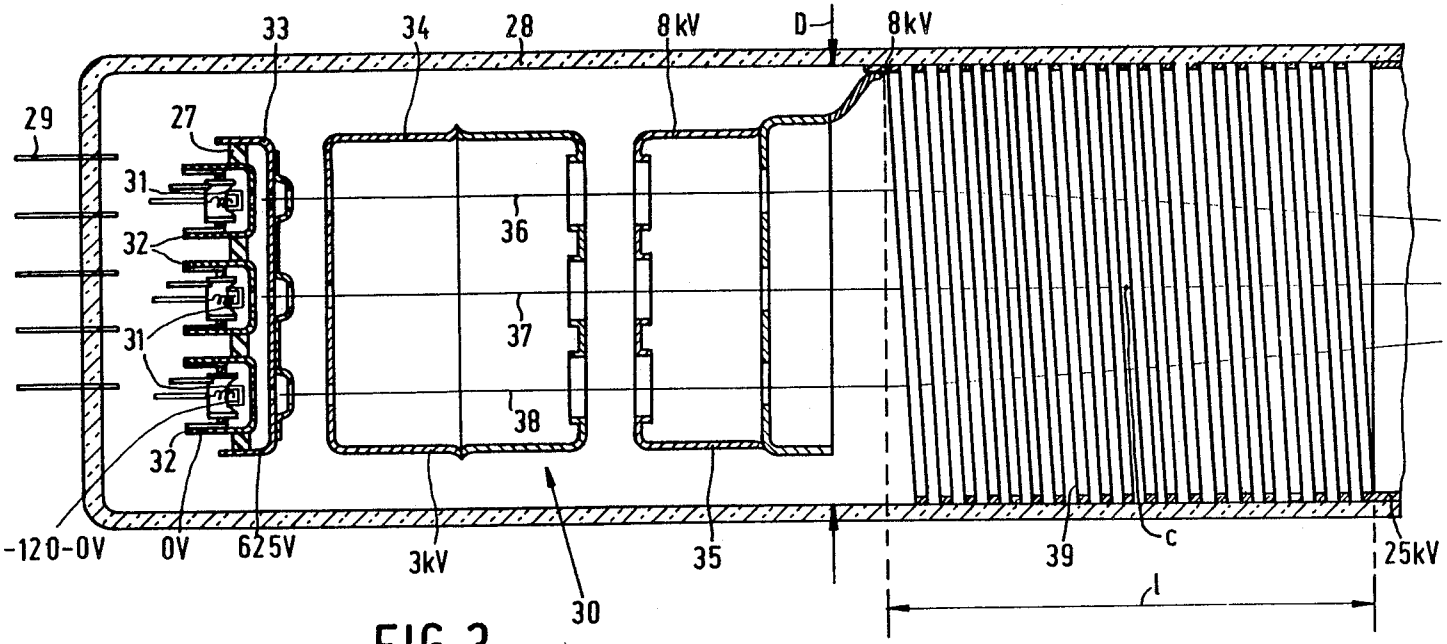
FIG. 3 is a longitudinal sectional view of a neck of a cathode ray tube in accordance with the invention having a bi-potential helical lens.

FIG. 3 is a longitudinal sectional view of a neck 28 of a cathode ray tube having an electron gun system succeeded by a bi-potential helical lens. The connections of the connection pins 29 to the electrodes of the electron gun system are not shown to avoid complexity. The inside diameter D of the neck is 28 mm. The length 1 of the helix is also 28 mm. The electron gun system 30 comprises three integrated electron guns. The cathodes 31 are present in the first grids 32 which in turn are assembled in the second grid 33 which is common to the three electron guns. The cathodes, first grid and second grids are connected together by means of ceramic material 27. The connection of the other electrodes is done in the conventional manner by glass rods, not shown. Between the oppositely located apertures in the common electrodes 34 and 35, the focusing lenses for the three electron beams 36, 37 and 38 are formed by applying voltages. The applied voltages are indicated at the various electrodes. The parallel electron beams emanating from the electron gun system 30 are converged by the bi-potential helical lens 39 so that the spots of the three beams on the display screen situated 280 mm farther from the centre C of the helical lens along beam 37 are incident one on the other. The voltage across the helical lens on convergence is 17 kV.

Figure 4:
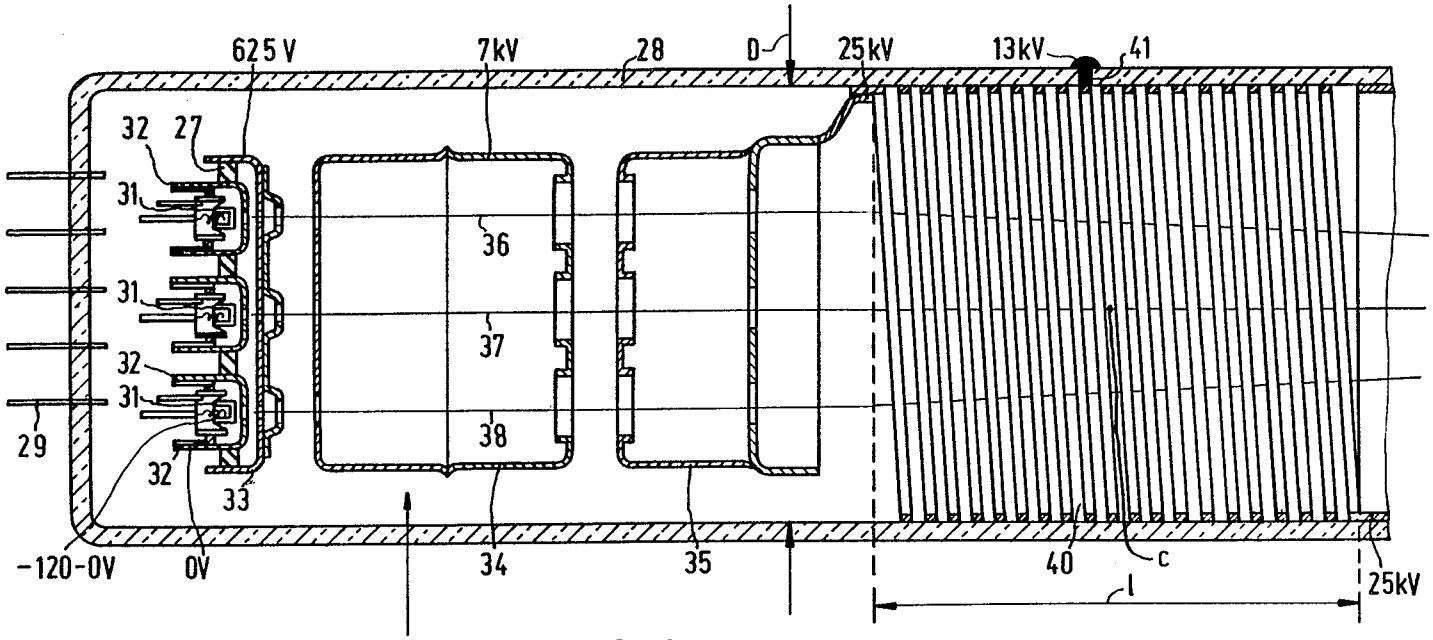
FIG. 4 is a longitudinal sectional view of a neck of a cathode ray tube in accordance with the invention having a uni-potential helical lens.

FIG. 4 shows analogously to FIG. 3 a longitudinal sectional view of a neck 28 of a cathode ray tube having an electron gun system succeeded by a uni-potential helical lens. The connections of the connection pins 29 to the electrodes of the electron gun system are again not shown to avoid complexity of the Figure. The inside diameter D of the neck is 28 mm. The length 1 of the helix is also 28 mm. The electron gun system 30 is identical to that described with reference to FIG. 3. The applied voltages are again indicated at the various electrodes. The parallel electron beams emanating from the electron gun system 30 are converged by a uni-potential helical lens 40 so that the spots of the three beams on the display screen situated 280 mm farther from the centre C of the helical lens along beam 37 are incident one on the other. The helical lens has a tap in the form of an electric glass lead-through 41. The uni-potential helical lens is obtained by applying to the tap a higher or lower potential (in this case 30 kV) compared with the voltages at the helical ends (in this case 25 kV).

Figure 5:
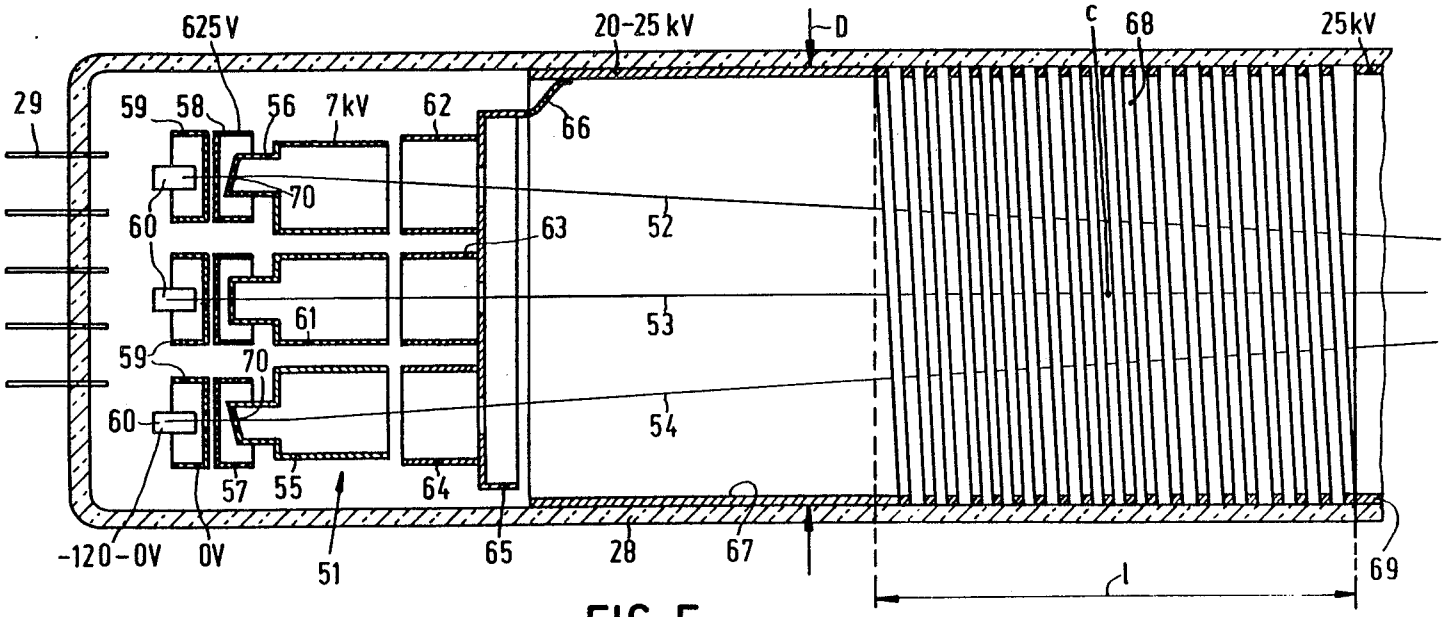
FIG. 5 is a longitudinal sectional view of a neck of a cathode ray tube in accordance with the invention having a bi-potential helical lens for dynamic convergence correction.

FIG. 5 is a longitudinal sectional view, analogous to FIGS. 3 and 4, of a neck 28 of a cathode ray tube having a bi-potential helical lens. The connections of the connection pins 29 to the electrodes of the electron gun system are again not shown to avoid complexity of the Figure. The inside diameter D of the neck is 28 mm. The length 1 of the helix is also 28 mm. The electron gun system 51 is a system having separate electron guns as disclosed in U.S. Pat. No. 4,291,251. The convergence of the electron beams 52, 53 and 54 is obtained in this case by causing the ends 70 of the electrodes 55 and 56 which are situated opposite to the electrodes 57 and 58 and which normally enclose an angle of 90° with the gun axis, to enclose an angle of approximately 87° with the gun axis. The cathodes 60 are present in the first grids 59. The electron beams are focused by means of lens fields between the electrodes 56 and 62, the electrodes 61 and 63, and the electrodes 55 and 64. The electrodes 62, 63 and 64 are connected to a centering cup 65 which is electrically connected by means of a contact spring to the electrically conductive wall coating 67. The helical lens 68 is provided between the coating 67 and the wall coating 69 of the cone which is connected to the aluminium coating of the display screen. Wall coating 69 is also connected to the high voltage contact 22 (see FIG. 1) and is kept at a voltage of 25 kV. By varying the voltage at the other end of helical lens 68 during the deflection (for example 20–25 kV) it is possible to cause the convergence to take place dynamically all over the display screen. In that case it is no longer necessary to use self-converging deflection coils, which type of coils has the disadvantage that deflection defocusing takes place in the vertical direction. Of course it is also possible to replace the bi-potential helical lens of FIG. 5 by a uni-potential lens of FIG. 4. Of course the invention is not restricted to helical lenses which are provided on the inner wall of a tube neck. For example, box-shaped cathode ray tubes are known in which such a helical lens can be provided on the inner wall of a cylinder of an insulating material (for example glass) which is assembled in the box-shaped envelope so as to be coaxial with the electron gun system.

What is claimed is:

1. An improved cathode ray tube comprising an envelope having a longitudinal axis, a display screen, an electron gun system disposed on said axis for producing and focusing a plurality of electron beams directed at the display screen, and deflection means longitudinally-spaced from said system for deflecting said beams across said screen, wherein the improvement comprises convergence means for converging the beams substantially at the screen independently of said focusing, said convergence means comprising a helically-wound, beam-surrounding resistive element disposed between the electron gun system and the deflection means, said element having a maximized diameter D and extending along the path of propagation of the electron beams by a length 1 which is no longer than twice said diameter, said element further including longitudinally-separated means for applying predetermined potentials thereto which effect production of a potential gradient along said length to establish a large diameter, high strength electromagnetic convergence lens through which the electron beams pass.

2. A cathode ray tube as in claim 1, characterized in that the electron gun system is configured to produce electron beams which are substantially parallel to each other when they enter the convergence lens, the focus of said convergence lens being situated substantially at the display screen.

3. A cathode ray tube as in claim 1, characterized in that the electron gun system is configured to produce electron beams which have already begun to converge, said convergence lens effecting completion of the electron beam convergence substantially at the display screen.

4. A cathode ray tube as in claim 3, characterized in that the potentials applied to the resistive element effect dynamic convergence of the electron beams during deflection.

5. A cathode ray tube as in claim 1, 2, 3 or 4, characterized in that different potentials are applied to opposite ends of the resistive element to effect production of a bi-potential convergence lens.

6. A cathode ray tube as in claim 1, 2, 3 or 4, characterized in that substantially equal potentials are applied to opposite ends of the resistive element and a different potential is applied to an intermediate part of said element, thereby effecting production of a uni-potential lens.

7. A cathode ray tube as in claim 1, 2, 3 or 4, characterized in that the envelope has a cylindrical neck, said resistive element being disposed on an inner wall of said neck.

8. A cathode ray tube as in claim 1, 2, 3 or 4, comprising a color data graphic display device.

9. A cathode ray tube as in claim 1, 2, 3 or 4, comprising a projection television display tube.

10. A cathode ray tube as in claim 1, 2, 3 or 4, including a cylindrical member of insulating material disposed in the envelope, said resistive element being disposed on an inner wall of said member.

* * * * *